US006825162B2

(12) United States Patent
Hazenkamp et al.

(10) Patent No.: US 6,825,162 B2
(45) Date of Patent: Nov. 30, 2004

(54) PROCESS FOR THE PREPARATION OF WATER-SOLUBLE GRANULES OR PARTICLES OF SALDIMINE-TYPE MANGANESE COMPLEXES

(75) Inventors: Menno Hazenkamp, Riehen (CH); Bryan David Grey, Bradford (GB); Kishor Kumar Mistry, Bradford (GB); Frank Bachmann, Freiburg (DE); Josef Dannacher, Basel (CH); Kenneth Charles Symes, Keighley (GB); Petr Kvita, Reinach (CH); Susanne Maier, Grenzach-Wyhlen (DE)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 10/470,046

(22) PCT Filed: Jan. 18, 2002

(86) PCT No.: PCT/EP02/00512

§ 371 (c)(1),
(2), (4) Date: Mar. 11, 2004

(87) PCT Pub. No.: WO02/059245

PCT Pub. Date: Aug. 1, 2002

(65) Prior Publication Data

US 2004/0142842 A1 Jul. 22, 2004

(30) Foreign Application Priority Data

Jan. 26, 2001 (EP) ..... 01810078
Aug. 17, 2001 (EP) ..... 01810795

(51) Int. Cl.[7] ..... C11D 11/00; C11D 17/06; C11D 7/32

(52) U.S. Cl. ..... 510/457; 510/311; 510/376; 510/446; 502/200; 502/324

(58) Field of Search ..... 510/311, 376, 510/446; 502/200, 324

(56) References Cited

U.S. PATENT DOCUMENTS

| | | | | |
|---|---|---|---|---|
| 5,324,445 | A | 6/1994 | Langley et al. | 252/174.12 |
| 6,080,710 | A | 6/2000 | Withenshaw et al. | 510/312 |

FOREIGN PATENT DOCUMENTS

| | | |
|---|---|---|
| EP | 0361677 | 4/1990 |
| EP | 630964 | * 12/1994 |
| EP | 717103 | * 6/1996 |
| EP | 0902083 | 3/1999 |
| WO | 01/09276 | 2/2001 |

* cited by examiner

*Primary Examiner*—Gregory R. Del Cotto
(74) *Attorney, Agent, or Firm*—Kevin T. Mansfield

(57) ABSTRACT

Water soluble granules or particles of saldimine-type manganese complexes that are suitable as catalysts in reactions with peroxy compounds are described. The granules are used especially in washing agents. They are distinguished by retarded disssolution of and improved action of the manganese complexes.

8 Claims, No Drawings

PROCESS FOR THE PREPARATION OF WATER-SOLUBLE GRANULES OR PARTICLES OF SALDIMINE-TYPE MANGANESE COMPLEXES

The present invention relates to a process for the preparation of water-soluble granules or particles of saldimine-type manganese complexes and a polymeric dissolution restrainer and to the use thereof as dye-transfer inhibitors in washing agent preparations.

A number of saldimine-type manganese complexes (or salen-type manganese complexes) are already known to be suitable catalysts for oxidations with peroxy compounds, especially within the context of washing procedures. The use of certain manganese complexes as catalysts for preventing the redeposition of migrating dyes in peroxide-containing washing liquors is described for example in EP 902 083, but the action of those manganese complexes as dye-transfer inhibitors is not optimum under all washing conditions. A further problem is that the peroxy compound and/or the catalyst in the washing agent formulation decompose(s) during prolonged storage in a moist atmosphere.

Surprisingly, it has now been found that granules or particles comprising a saldimine-type manganese complex and at least 10% by weight of a polymeric dissolution restrainer which are prepared according to the inventive process provide better inhibition of the redeposition of migrating dyes in washing liquors than is provided by the pure manganese complexes when the total amount of manganese complex entering into the washing liquor is the same in both cases. A further advantage of the granules or particles is that the storage stability of peroxide-containing washing agent formulations comprising such granules or particles is improved. In addition, these granules or particles inhibit undesired colouration of the washing agent as a result of the gradual dissolution of the manganese complexes in one or more of the washing agent components.

The present invention accordingly relates to a process for the preparation of water-soluble granules or particles of saldimine-type manganese complexes and a polymeric dissolution restrainer, comprising a) mixing the polymeric material with water and subsequently dissolving/suspending the saldimine-type manganese complex in it to form an aqueous polymer phase containing the saldimine-type manganese complex substantially uniformly distributed throughout the phase, b) simultaneously or subsequently dispersing the aqueous phase in a water immiscible liquid in the presence of a dispersion stabiliser to form a substantially stable dispersion, and c) azeotroping the dispersion to form substantially dry particles each comprising a matrix of the polymeric material with the saldimine-type manganese complex dispersed substantially uniformly throughout the matrix.

As manganese complexes for the granules or particles according to the invention there come into consideration compounds that contain, complexed with manganese, from 1 to 3 saldimine groups, that is to say, groups obtainable by condensing unsubstituted or substituted salicylaldehydes with amines.

Especially suitable are compounds of formula (1)

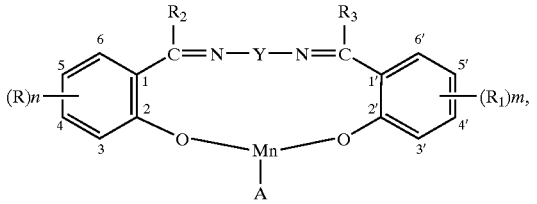

(2)

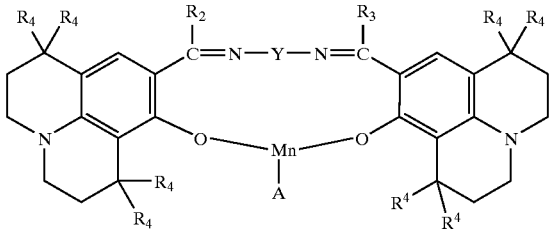

(3)

or

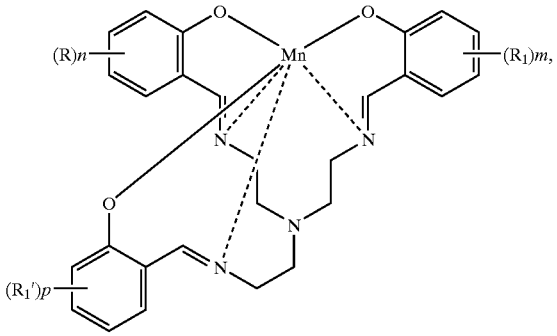

wherein

A is an anion;

m, n and p are each independently of the others 0, 1, 2 or 3, $R_4$ is hydrogen or linear or branched $C_1$–$C_4$alkyl, Y is a linear or branched alkylene radical of formula —$[C(R_4)_2]_r$—, wherein r is an integer from 1 to 8 and the $R_4$ radicals are each independently of the others as defined above;

—CX=CX—, wherein X is cyano, linear or branched $C_1$–$C_8$alkyl or di(linear or branched $C_1$–$C_8$alkyl) amino;

—$(CH_2)_q$—$NR_4$—$(CH_2)_q$—, wherein $R_4$ is as defined above and q is 1, 2, 3 or 4; or a 1,2-cyclohexylene radical of formula:

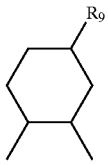

or a 1,2-aryl radical of formula

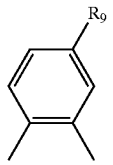

wherein $R_9$ is hydrogen, $SO_3H$, $CH_2OH$ or $CH_2NH_2$,

R, $R_1$ and $R_1'$ are each independently of the others cyano; halogen; $OR_4$ or $COOR_4$ wherein $R_4$ is as defined above; nitro; linear or branched $C_1$–$C_8$alkyl; linear or branched partially fluorinated or perfluorinated $C_1$–$C_8$alkyl; or $NHR_6$, $NR_5R_6$ or $N^{\oplus}R_5R_6R_7$ wherein $R_5$, $R_6$ and $R_7$ are the same or different and are each hydrogen or linear or branched $C_1$–$C_{12}$alkyl or wherein $R_5$ and $R_6$ together with the nitrogen atom to which they are bonded form a 5-, 6- or 7-membered ring, which may contain further hetero atoms, or are linear or branched $C_1$–$C_8$alkyl-$R_8$ wherein $R_8$ is a radical $OR_4$, $COOR_4$ or $NR_5R_6$ as defined above or is $NH_2$ or $N^{\oplus}R_5R_6R_7$ wherein $R_5$, $R_6$ and $R_7$ are as defined above, $R_2$ and $R_3$ are each independently of the other hydrogen, linear or branched $C_1$–$C_4$alkyl, unsubstituted aryl or aryl that is substituted by cyano, by halogen, by $OR_4$ or $COOR_4$ wherein $R_4$ is hydrogen or linear or branched $C_1$–$C_4$alkyl, by nitro, by linear or branched $C_1$–$C_8$alkyl, by $NHR_5$ or $NR_5R_6$, wherein $R_5$ and $R_6$ are the same or different and are each linear or branched $C_1$–$C_{12}$alkyl or wherein $R_5$ and $R_6$ together with the nitrogen atom to which they are bonded form a 5-, 6- or 7-membered ring, which may contain further hetero atoms, by linear or branched $C_1$–$C_8$alkyl-$R_7$ wherein $R_7$ is an $OR_4$, $COOR_4$ or $NR_5R_6$ radical as defined above or is $NH_2$, or by $N^{\oplus}R_5R_6R_7$ wherein $R_5$, $R_6$ and $R_7$ are as defined above.

When, in the compounds of formulae (1) and (3), R, $R_1$, $R_1'$ and/or $R_8$ are $N^{\oplus}R_5R_6R_7$ or $R_2$ and/or $R_3$ are $N^{\oplus}R_5R_6R_7$-substituted aryl wherein $R_5$, $R_6$ and $R_7$ are as defined above, the following anions are suitable for balancing the positive charge on the $N^{\oplus}R_5R_6R_7$ group: halide, for example chloride, perchlorate, sulfate, nitrate, hydroxide, $BF_4^-$, $PF_6^-$, carboxylate, acetate, tosylate and triflate. Of those anions, bromide and chloride are preferred.

In compounds of formulae (1) and (3) in which n, m or p is 2 or 3, the radicals R, $R_1$ and $R_1'$ have the same or different meanings.

When Y is a 1,2-cyclohexylene radical, it may be present in any of its stereoisomeric cis/trans forms.

Preferably, Y is a radical of formula —$(CH_2)_r$— wherein r is an integer from 1 to 4, especially 2, or is a radical of formula —$C(R_4)_2$—$(CH_2)_p$—$C(R_4)_2$— wherein p is a number from 0 to 3, especially 0, and each $R_4$, independently of the others, is hydrogen or $C_1$–$C_4$alkyl, especially hydrogen or methyl, or is a 1,2-cyclohexylene radical or a 1,2-phenylene radical of formula:

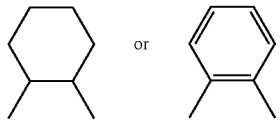

Halogen is preferably chlorine, bromine or fluorine, chlorine being especially preferred.

When n, m or p is 1, the groups R, $R_1$ and $R_1'$ are preferably in the 4-position of the respective benzene ring except when R, $R_1$ or $R_1'$ is nitro or $COOR_4$, in which case that group is preferably in the 5-position. When R, $R_1$ or $R_1'$ is a $N^{\oplus}R_5R_6R_7$ group, that group is preferably in the 4- or 5-position.

When n, m or p is 2, the two R, $R_1$ or $R_1'$ groups are preferably in the 4,6-position of the respective benzene ring except when they are nitro or $COOR_5$, in which case the two groups are preferably in the 3,5-position.

When R, $R_1$ or $R_1'$ is di($C_1$–$C_{12}$alkyl)amino, the alkyl group may be straight-chain or branched. Preferably, it contains from 1 to 8, especially from 1 to 3, carbon atoms.

Preferably, the radicals R, $R_1$ and $R_1'$ are hydrogen, $OR_4$, $N(R_4)_2$ or $N^{\oplus}(R_4)_3$, wherein the $R_4$ groups in $N(R_4)_2$ or $N^{\oplus}(R_4)_3$ may be different and are hydrogen or $C_1$–$C_4$alkyl, especially methyl, ethyl or isopropyl.

The radicals $R_2$ and $R_3$ are especially hydrogen, methyl, ethyl or unsubstituted phenyl.

Aryl is, for example, naphthyl or, especially, phenyl.

When $R_5$ and $R_6$ together with the nitrogen atom to which they are bonded form a 5-, 6- or 7-membered ring, the ring is especially a pyrrolidine, piperidine, morpholine or piperazine ring. The piperazine ring may be substituted, for example by alkyl, at the nitrogen atom that is not bonded to the phenyl or alkyl radical.

Suitable anions A include, for example, halide, such as chloride or bromide, perchlorate, sulfate, nitrate, hydroxide, $BF_4^-$, $PF_6^-$, carboxylate, acetate, tosylate and triflate. Of those anions, chloride, bromide and acetate are preferred.

The compounds of formulae (1), (2) and (3) are known or can be prepared in a manner known per se. The manganese complexes are prepared from the corresponding ligands and a manganese compound. Such preparation procedures are described, for example, in U.S. Pat. Nos. 5,281,578 and 4,066,459 and by Bernardo et al., Inorg. Chem. 45 (1996) 387.

Preferred formulations of the granules or particles comprise from 1 to 90% by weight, especially from 1 to 30% by weight, of saldimine-type manganese complex of formula (1), (2) or (3), based on the total weight of the granules or particles.

Instead of a single, homogeneous manganese complex of formula (1), (2) or (3) it is also possible to use mixtures of two or more manganese complexes of formula (1), (2) or (3). Mixtures of one or more manganese complexes of formula (1), (2) or (3) and one or more saldimine-type ligands can also be used. Saldimine-type ligands suitable for such mixtures include all ligands that are used as starting compounds in the preparation of the manganese complexes of formula (1), (2) and (3).

As polymeric dissolution restrainers for the granules or particles according to the invention there come into consideration polymeric compounds that cause the manganese complexes to dissolve in water more slowly than they would without the dissolution restrainers.

Such polymers may be used individually or in the form of mixtures of two or more polymers. The polymer is added because, during later use of the granules or particles in the washing agent, the dissolution of the saldimine-type manganese complex in the washing liquor is to be controlled, and/or when an enhanced action as dye inhibitor is desired.

As water-soluble polymers in the inventive process there come into consideration, for example, polyethylene glycols, copolymers of ethylene oxide with propylene oxide, gelatin, polyacrylates, polymethacrylates, polyvinylpyrrolidones, vinylpyrrolidones, vinyl acetates, polyvinylimidazoles, polyvinylpyridine N-oxides, copolymers of vinylpyrrolidone with long-chained α-olefins, copolymers of vinylpyrrolidone with vinylimidazole, poly(vinylpyrrolidone/dimethylaminoethyl methacrylates), copolymers of vinylpyrrolidone/dimethylaminopropyl methacrylamides, copolymers of vinylpyrrolidone/dimethylaminopropyl acrylamides, quaternised copolymers of vinylpyrrolidones and dimethylaminoethyl methacrylates, terpolymers of vinylcaprolactam/vinylpyrrolidone/dimethylaminoethyl methacrylates, copolymers of vinylpyrrolidone and methacrylamidopropyl-trimethylammonium chloride, terpolymers of caprolactam/vinylpyrrolidone/dimethylaminoethyl methacrylates, copolymers of styrene and acrylic acid, polycarboxylic acids, polyacrylamides, carboxymethylcellulose, hydroxymethylcellulose, polyvinyl alcohols, optionally hydrolysed polyvinyl acetate, copolymers of ethyl acrylate with methacrylate and methacrylic acid, copolymers of maleic acid with unsaturated hydrocarbons and mixed polymerisation products of the said polymers.

Further polymers that come into consideration are synthetic polymers formed from an ethylenically unsaturated water soluble cationic monomer or monomer blend. Suitable cationic monomers are dialkylaminoalkyl (meth)-acrylamides and, preferably, -acrylates, usually as acid addition or quaternary ammonium salts. Particularly preferred are monomers such as diethylaminoethyl (meth) acrylate.

Among those organic polymers, special preference is given to carboxymethylcellulose, polyethylen glycols, polyacrylamides, polyvinyl alcohols, polyvinylpyrrolidones, gelatin, hydrolysed polyvinyl acetate, copolymers of vinylpyrrolidone and vinyl acetate and also polyacrylates, copolymers of ethyl acrylate with methacrylate and methacrylic acid and polymethacrylates.

The soluble polymer may have been made by any conventional polymerisation technique, such as reverse phase suspension polymerisation, solution polymerisation, reverse phase bead polymerisation or gel polymerisation. Alternatively, the polymer may be a copolymer of soluble and insoluble monomers (e.g., methacrylic acid and ethyl acrylate) and may have been made by oil-in-water emulsion polymerisation followed by addition of sodium hydroxide or other alkali to convert it to a soluble form.

The polymeric dissolution restrainer is used in an amount of from 10 to 98% by weight, preferably from 40 to 90% by weight and especially from 60 to 90% by weight, based on the total weight of the granules or particles.

The invention also relates to granules or particles made according to the inventive process, comprising a) from 1 to 89% by weight, preferably from 1 to 30% by weight, of a water-soluble saldimine-type manganese complex, b) from 10 to 98% by weight of a polymeric dissolution restrainer, c) from 0 to 20% by weight of a further additive and d) from 1 to 20% by weight of water, based on the total weight of the granules.

The granules or particles according to the invention may comprise further additives, for example wetting agents, water-insoluble or water-soluble dyes or pigments and also fillers and optical brighteners. Such additives are present in an amount of from 0 to 20% by weight, based on the total weight of the granules or particles.

The granules or particles obtained according to the inventive process are resistant to abrasion, low in dust, are free-flowing and easily metered. A distinguishing feature is that their rate of dissolution in water is controllable by the composition of the formulation. They are used especially in washing agent formulations as dye-transfer inhibitors. They can be added directly to a washing agent formulation at the desired concentration of the saldimine-type manganese complex. The present invention relates also to that use.

Where the coloured appearance of the granules or particles in the washing agent is to be suppressed, that can be achieved, for example, by embedding the granules or particles in droplets consisting of a whitish meltable substance ("water-soluble wax"), or by adding a white pigment (e.g. $TiO_2$) to the granule formulation or, preferably, by encasing the granules or particles with a melt consisting, for example, of a water-soluble wax, as described in EP-B-0 323 407 B1, a white solid (e.g. titanium dioxide) being added to the melt in order to reinforce the masking effect of the casing.

The inventive process avoids the exposure of the saldimine-type manganese complex to the exotherm, initiator and other conditions associated with a polymerising mixture. It allows the drying to be carried out under carefully controlled conditions so as to avoid overheating both on a macro scale and on a micro scale. Since the heating can be controlled very carefully, it is possible to minimise the risk of deactivation of the saldimine-type manganese complex and thus it is possible to produce particles having a very satisfactory catalytic activity.

The size of the substantially dry particles is dictated by the size of the dispersed aqueous phase particles in the immiscible liquid. It is often desired that the dry particles are beads that have a size of at least 30 μm, often at least 100 μm, for instance up to 500 μm or up to 1 mm or even 2 mm or larger. With particles of this size, the substantially dry particles will be separated from the water immiscible liquid by filtration, centrifugation or other conventional separation methods and may be subjected to further drying after the separation. This further drying may be by solvent exchange but is preferably by warm air, for instance in a fluidised bed.

The beads must be dried sufficiently that they are non-sticky and are generally dried to a moisture content that is in equilibrium with the environment or is drier than this.

A particular advantage of the process of the invention is that it is easily possible to produce beads of a very regular shape and narrow size range. This is only possible because the drying is by azeotroping and because the active ingredient and polymer are first dispersed in water-immiscible liquid.

Another advantage of the particles produced by the process of the invention is that the bulk density of the particles is much higher compared with particles of the same composition but produced by a more conventional method such as spray drying.

Although the production of these beads is usually preferred, another benefit of the process is that it is possible also to make much smaller, dry, particles. Thus the particles may, however, be below 30 μm for instance generally below 10 μm and often below 3 μm.

An important feature is that the saldimine-type manganese complex is not protected from the environment merely by an encapsulating shell of polymer (that is liable to become damaged) but is instead protected by being distributed throughout a matrix of the polymer.

The process of the invention is of particular value when the saldimine-type manganese complex is one that would interfere with or be damaged by monomer from which the polymer is made or would tend to be deactivated (either by evaporation or desensitisation) if exposed to exothermic polymerisation. The process of the invention is therefore of particular value when the saldimine-type manganese complex is a sensitive material that is liable to be desensitised.

The polymer should be film forming in the sense that the polymeric residue will form a coherent matrix as a result of the azeotropic evaporation of most or all of the water. The polymer is preferably soluble in the aqueous phase containing the saldimine-type manganese complex and may be introduced into the aqueous phase either as a preformed aqueous solution or in any other convenient form.

Instead of introducing the polymer in a soluble form, the polymer can be a polymer that is insoluble in water but is soluble in alkali and which is introduced as an oil-in-water emulsion that has been made by emulsion polymerisation of ethylenically unsaturated monomer or monomer blend that is insoluble in the water phase of the polymerisation mixture. The monomers are generally a blend of anionic solubilising monomers (typically selected from the anionic monomers discussed above) and ethylenically unsaturated non-ionic monomers, the overall blend being insoluble at the pH of the emulsion. Thus the emulsion polymerisation may be conducted at a pH below 7 but when the polymer is subsequently exposed to more alkaline conditions the polymer becomes soluble (or highly swellable). Suitable non-ionic water insoluble monomers include alkyl (meth) acrylates, styrene, acrylonitrile, vinyl chloride, vinyl acetate or vinyl butyl ether. Ethyl acrylate is preferred, with the polymer preferably being formed from 10 to 70% methacrylic acid or other anionic monomer, 10 to 70% ethyl acrylate or other insoluble monomer and 0 to 70% acrylamide or other soluble non-ionic monomer.

The use of an emulsion polymer of this type is of particular value when it is desired for the polymeric matrix to permit substantially no release of the saldimine-type manganese complex in one environment (for instance neutral or acidic) and rapid release in an alkaline environment.

Controlled release of the saldimine-type manganese complex can also be obtained when the polymer is introduced initially as a salt with a volatile amine (for instance ammonia) of a polymer derived from ethylenically unsaturated carboxylic acid monomer such as (meth) acrylic acid. The salt is soluble in water but the ammonia or other volatile amine evaporates during the azeotroping to render the polymer less hydrophilic. Accordingly at least the outer shell of the particles, and possibly substantially the entire polymeric matrix, will be less hydrophilic and water soluble than when the carboxylic groups are in alkali or amine salt form. The particle therefore has relatively low permeability to ambient moisture but, upon exposure to a slightly alkaline aqueous solution (for instance as typically prevails in a wash liquid) the polymer will be sufficiently solubilised to permit release of the trapped saldimine-type manganese complex. For this purpose the polymer is preferably based on 0 to 50% acrylamide and 50 to 100% acrylic acid or, preferably, methacrylic acid. Products of these types are described in more detail in EP 0361677.

The molecular weight of the polymer will be selected having regard to the concentration and solution viscosities that are required and, especially, the gel strength that is required in the final beads. If the molecular weight of a solution polymer is too high it can be difficult to form a stable dispersion of aqueous polymer particles containing a commercially useful concentration of active ingredient and so for many polymers the molecular weight should be below 1 million, often below 500,000. If the molecular weight is too low the final gel strength may be inadequate, even if the beads do have surface cross linking. In some instances the molecular weight may be down to, for instance, 4,000 or even 2,000. A range of 5,000 to 300,000 is often suitable.

The polymers that are used in the process of the invention may be unreactive polymers, i.e., polymers that cannot undergo any significant chain extension even though it may be possible to cause cross linking through pendant groups since any such cross linking does not usually result in any significant exotherm or other conditions that might damage the active ingredient. It is also possible to use a polymer that undergoes chain extension by addition polymerisation during the process provided this does not involve the presence of deleterious amounts of initiator, exotherm or other conditions that might damage the active ingredient. The risk of this can be minimised by ensuring that the reactive polymer already has a substantial chain length, for instance at least 50 and usually at least 100 carbon atoms in the chain. Depending upon the degree of unsubstitution in the reactive polymer, the final polymer may be linear or may be cross linked and, if cross linked, the polymeric matrix will then be swellable rather than soluble. Preferred reactive polymers are described in EP-A-0328321.

The polymer may undergo cross linking before, after or preferably during the azeotroping. For instance it is known that many polymers, especially those containing anionic groups, can undergo ionic cross linking if exposed to polyvalent metal compounds and so the inclusion of such compounds in the aqueous solution of polymer or in the non-aqueous liquid or both can result in cross linking. If the polyvalent metal compound is preferentially soluble in the non-aqueous liquid (for instance being aluminium isopropoxide or other polyvalent metal alkoxide) then the cross linking will be concentrated primarily at the surface of the particles. If the cross linking agent is preferentially soluble in the aqueous solution of polymer then the cross linking may occur substantially uniformly throughout the particles. Cross linking agents such as glutaraldehyde can be used with appropriate polymers.

By appropriate selection of the type and amount of cross linking it is possible to control the physical properties of the particles. For instance it is possible to control the release of active ingredient from the particles and/or to increase the gel strength of the particles and/or to increase the hardness, or reduce the stickiness, of the surface of the particles. Also, if the cross linking is concentrated on the surface of the particles, the resultant particles tend to dissolve more rapidly into water.

Instead of achieving cross linking during the process of the invention, it is also possible (especially when the polymer is initially produced as an oil-in-water emulsion) to provide the polymer initially as a cross linked polymer. However generally the polymer is linear and has been made substantially in the absence of cross linking monomer or other cross linking agent.

The polymer can serve to give controlled release, for instance under selected pH conditions as described above, or can serve merely as a relatively inert material that will bond the saldimine-type manganese complex into the desired on-dusty particles and that will give the desired release profile into the wash-liquor at the appropriate time. In addition, the polymer can serve to provide useful properties in the wash-liquor. it is particularly convenient for the polymeric matrix to be a polymer that is useful as a component in a detergent, for instance as a detergent builder, a detergent anti-redeposition aid or a dye transfer inhibition agent. Suitable polymers include carboxy methyl cellulose polyvinyl pyrolidone, polyvinyl alcohol and anionic synthetic polymers, for instance polymers of ethylene and (meth) acrylic acid and other polymers preferably of molecular weight 4,000 to 300,000 and formed from water soluble ethylenically unsaturated carboxylic or sulphonic monomer, optionally with water soluble non-ionic monomer.

The polymeric material can be blended with the saldimine-type manganese complex to form an aqueous polymer phase containing both the polymer and the saldimine-type manganese complex, and this phase can then be dispersed in the water immiscible liquid. Alternatively, the saldimine-type manganese complex can be dispersed in the water immiscible liquid and the polymer then added (usually as a pre-formed solution or emulsion) or alternatively the polymer can be dispersed and the saldimine-type manganese complex then added. In each instance sufficient agitation should be provided to ensure that the dispersed aqueous particles in the water immiscible liquid have a substantially uniform content of both polymer and the saldimine-type manganese complex.

The aqueous phase must itself be substantially stable since if there is a tendency for it to undergo phase separation this will interfere with the formation and maintenance of a uniform dispersion in the water immiscible liquid. The aqueous phase is preferably therefore one which is stable in bulk and does not undergo phase separation. If the saldimine-type manganese complex is ionic, it is preferred for the polymer to be non-ionic or co-ionic. For instance when the saldimine-type manganese complex is cationic, there can be a risk that some anionic polymers may cause destabilisation, in which event the aqueous phase should be stabilised. This can be achieved by thickening the aqueous phase and/or by adding a polyhydroxy compound, especially sucrose or other sugar or a glycol or other low molecular weight polyhydroxy compound, e.g., propylene glycol.

The aqueous phase can also include other additives that are optional for the intended use of the final product. For instance the solution may often contain inert fillers such as clays and/or pigments or dyes.

The resultant dispersion of aqueous particles containing polymer and saldimine-type manganese complex must be sufficiently stable that it can be subjected to azeotropic distillation and for this purpose it is generally necessary for the dispersion to include a polymeric dispersion stabiliser, at sometimes also an emulsifier surfactant.

The concentration of the polymer in the polymer solution will be selected according to the molecular weight and solution viscosity of the polymer but is often in the range 5 to 50%, typically 20 to 30%.

The particle size of the aqueous droplets and the final dry particles can be controlled by choice of the amount of shear to which the dispersion is subjected, choice and amount of stabiliser, and choice and amount of surfactant. When the end product is to be a stable dispersion in oil or other immissible liquid, it is preferred to use a water-in-oil emulsifier to promote the formation of small particles having a size below 10 $\mu$m, for instance below 3 $\mu$m. However when beads are required, for instance above 30 and usually above 70 $\mu$m, the emulsifier may be omitted.

The polymeric stabiliser is generally an amphipathic stabiliser, for instance, formed from hydrophilic and hydrophobic acrylic monomers. Suitable surfactants, non-aqueous liquids and polymeric stabilisers, and suitable azeotroping conditions, are described in, for instance, EP 0128661 and EP 0126528. The stabilisers described in GB 2,002,400 or, preferably, 2,001,083 or 1,482,515 are particularly preferred.

The immiscible liquid is non-aqueous and must include liquid that is usable for the removal of water by azeotroping.

The terms azeotroping or azeotrop used in the present application also encompass steam destillation.

Often the water immiscible liquid is a blend of a relatively high boiling liquid that remains in the dispersion and a low boiling liquid that is azeotroped from the dispersion. The temperature at which azeotroping occurs is generally below 100° C. and is controlled by the choice of liquid and, especially, the pressure at which the distillation is conducted. Generally the distillation is conducted under reduced pressure and when the saldimine-type manganese complex is temperature sensitive the reduced pressure is preferably such that the azeotroping occurs at a maximum temperature of not more than 80° C., often below 70° C. and most preferably below 50° C. For instance by applying a relatively high vacuum it is possible to azeotrope at very low temperatures, for instance as low as 30° C. Sodium sulphate or other salt may be added to lower the azeotroping temperature.

The polymer should be film forming at the distillation temperature, and usually is film forming at 20° C. or lower.

After azeotroping sufficient of the water from the particles to convert the particles into a substantially solid and non-sticky form, the particles (if sufficiently large) can then be separated from the non-aqueous liquid and can be further dried, if desired, in conventional manner, for instance on a fluidised bed.

Before or after azeotroping, the particles may be given a surface treatment to adjust their properties. For instance a polymer containing a water soluble salt of a relatively insoluble monomer may be converted to its less soluble form (e.g., sodium methacrylate in the surface of the particles may be converted to methacrylic acid). A relatively insoluble polymer or other hydrophobic material may be applied (e.g., an oil-in-water emulsion polymer may be applied, and will dissolve when the particles are mixed with wash water).

The present invention accordingly relates also to washing, cleaning, disinfecting and bleaching agent formulations comprising I) from 0 to 50% A) of an anionic surfactant and/or B) of a non-ionic surfactant, II) from 0 to 70% C) of a builder substance, III) from 1 to 99% D) of a peroxide and IV) E) granules or particles according to the invention in such an amount that in the treatment liquor the concentration of the saldimine manganese complex is from 0.5 to 50, preferably from 1 to 30 mg/l, if to the treatment liquor are added 0.5 to 20 g/l of the washing, cleaning, disinfecting and bleaching agent formulation.

The present invention preferably relates also to washing agent formulations comprising I) from 5 to 90%, preferably from 5 to 70%, A) of an anionic surfactant and/or B) of a non-ionic surfactant, II) from 5 to 70%, preferably from 5 to 50%, especially from 5 to 40%, C) of a builder substance, III) from 0.1 to 30%, preferably from 1 to 12%, D) of a peroxide and IV) E) granules or particles according to the invention in such an amount that the washing agent formulation comprises from 0.005 to 2%, preferably from 0.02 to 1%, especially from 0.1 to 0.5%, of the pure manganese complex of formula (1), (2) or (3). In each case, the percentage figures are percentages by weight, based on the total weight of the washing agent.

The washing agent may be in solid or liquid form, but in liquid form it is preferably a non-aqueous washing agent containing not more that 5% by weight, preferably from 0 to 1% by weight, of water and comprising as base a suspension of a builder substance in a non-ionic surfactant, for example as described in GB-A-2 158 454.

The washing agent is preferably, however, in the form of a powder or granules.

The powder or granules can be produced, for example, by first of all preparing a starting powder by spray-drying an aqueous suspension comprising all of the components listed above, with the exception of components D) and E), and then adding the dry components D) and E) and mixing everything together.

It is also possible to start with an aqueous suspension that comprises components A) and C) but not component B) or only a proportion of component B). The suspension is spray-dried and then component E) is mixed with component B) and the mixture is added to the suspension, and subsequently component D) is admixed dry.

Preferably, the components are mixed together in such amounts that a solid compact washing agent in the form of granules is obtained that has a specific weight of at least 500 g/l.

In a further preferred embodiment, the washing agent is prepared in three steps. In the first step a mixture of anionic surfactant (and, if desired, a small amount of non-ionic surfactant) and builder substance is prepared. In the second step that mixture is sprayed with the bulk of the non-ionic surfactant, and then in the third step peroxide, catalyst as appropriate, and the granules or particles according to the invention are added. That method is normally carried out in a fluidised bed.

In a further preferred embodiment, the individual steps are not carried out completely separately, resulting in a certain amount of overlap between them. Such a method is usually carried out in an extruder, in order to obtain granules in the form of "megapearls".

The anionic surfactant A) may be, for example, a sulfate, sulfonate or carboxylate surfactant or a mixture of such surfactants.

Preferred sulfates are those having from 12 to 22 carbon atoms in the alkyl radical, where appropriate in combination with alkyl ethoxysulfates in which the alkyl radical contains from 10 to 20 carbon atoms.

Preferred sulfonates include, for example, alkylbenzenesulfonates having from 9 to 15 carbon atoms in the alkyl radical and/or alkylnaphthalenesulfonates having from 6 to 16 carbon atoms in the alkyl radical.

The cation in the anionic surfactants is preferably an alkali metal cation, especially sodium.

Preferred carboxylates are alkali metal sarcosinates of formula $R—CO—N(R^1)—CH_2COOM^1$, wherein R is alkyl or alkenyl having from 8 to 18 carbon atoms in the alkyl or alkenyl radical, $R^1$ is $C_1$–$C_4$alkyl and $M^1$ is an alkali metal.

The non-ionic surfactant B) may be, for example, a condensation product of from 3 to 8 mol of ethylene oxide with 1 mol of primary alcohol that contains from 9 to 15 carbon atoms.

There come into consideration as builder substance C), for example, alkali metal phosphates, especially tripolyphosphates, carbonates or bicarbonates, especially the sodium salts thereof, silicates, aluminium silicates, polycarboxylates, polycarboxylic acids, organic phosphonates, aminoalkylenepoly(alkylenephosphonates) and mixtures of such compounds.

Especially suitable silicates are sodium salts of crystalline layer silicates of the formula $NaHSi_tO_{2t+1}.pH_2O$ or $Na_2Si_tO_{2t+1}.pH_2O$, wherein t is a number from 1.9 to 4 and p is a number from 0 to 20.

Among the aluminium silicates, preference is given to those obtainable commercially under the names zeolite A, B, X and HS and also to mixtures of two or more of those components.

Among the polycarboxylates, preference is given to polyhydroxycarboxylates, especially citrates, and acrylates and also copolymers thereof with maleic anhydride.

Preferred polycarboxylic acids are nitrilotriacetic acid, ethylenediaminetetraacetic acid and ethylenediamine disuccinate either in racemic form or in the enantiomerically pure S,S form.

Especially suitable phosphonates and aminoalkylenepoly(alkylenephosphonates) include alkali metal salts of 1-hydroxyethane-1,1-diphosphonic acid, nitrilotris(methylenephosphonic acid), ethylenediaminetetramethylenephosphonic acid and diethylenetriaminepentamethylenephosphonic acid.

As the peroxide component D) there come into consideration, for example, the organic and inorganic peroxides known in the literature and available commercially that bleach textiles at conventional washing temperatures, for example at from 10 to 95° C.

The organic peroxides are, for example, mono- or polyperoxides, especially organic peracids or salts thereof, such as phthalimidoperoxycaproic acid, peroxybenzoic acid, diperoxydodecanedioic acid, diperoxynonanedioic acid, diperoxydecanedioic acid, diperoxyphthalic acid or salts thereof.

Preference is given, however, to the use of inorganic peroxides, such as, for example, persulfates, perborates, percarbonates and/or persilicates. It will be understood that it is also possible to use mixtures of inorganic and/or organic peroxides. The peroxides may be in a variety of crystalline forms and may have different water contents, and they may also be used together with other inorganic or organic compounds in order to improve their storage stability.

The peroxides are added to the washing agent preferably by mixing the components together, for example using a screw metering system and/or a fluidised bed mixer.

The washing agent may comprise, in addition to the granules or particles according to the invention, one or more optical brighteners, for example from the group bistriazinylaminostilbenedisulfonic acid, bistriazolylstilbenedisulfonic acid, bisstyrylbiphenyl or bisbenzofuranylbiphenyl, a bisbenzoxalyl derivative, bisbenzimidazolyl derivative, coumarin derivative or a pyrazoline derivative.

The washing agents may furthermore comprise suspending agents for dirt, e.g. sodium carboxymethylcellulose, pH regulators, e.g. alkali metal or alkaline earth metal silicates, foam regulators, e.g. soap, salts for regulating the spray-drying and the granulating properties, e.g. sodium sulfate, perfumes and, optionally, antistatic agents and softeners, enzymes, such as amylase, bleaching agents, pigments and/or toning agents. It will be understood that such components must be stable towards the bleaching agent used.

Further preferred additives for the washing agents according to the invention are polymers that, during the washing of textiles, inhibit staining caused by dyes in the washing liquor that have been released from the textiles under the washing conditions. Such polymers are preferably polyvinylpyrrolidones, polyvinylimidazoles or polyvinylpyridine N-oxides which may have been modified by the incorporation of anionic or cationic substituents, especially those having a molecular weight in the range from 5000 to 60 000, more especially from 10 000 to 50 000. Such polymers are used preferably in an amount of from 0.05 to 5% by weight, especially from 0.2 to 1.7% by weight, based on the total weight of the washing agent.

In addition, the washing agents according to the invention may also comprise so-called perborate activators, such as, for example, TAED, SNOBS or TAGU. Preference is given to TAED, which is preferably used in an amount of from 0.05 to 5% by weight, especially from 0.2 to 1.7% by weight, based on the total weight of the washing agent.

The following examples serve to illustrate the invention; parts and percentages are by weight, unless otherwise stated.

The manganese complexes used in the examples are the compounds with structures (1a) and (3a), shown below (1a)

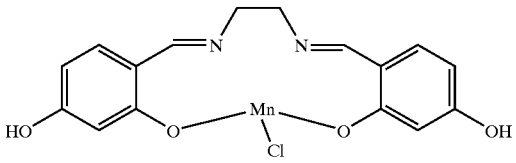

(3a)

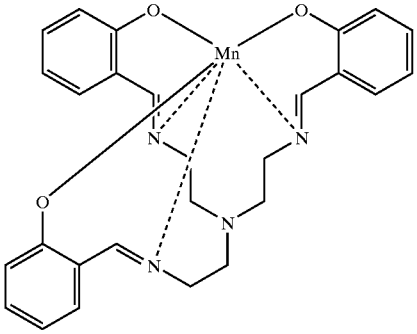

EXAMPLE 1

Preparation of Particles A 700 ml reaction flask equipped with motorized stirrer, reflux condenser and Dean & Stark apparatus is set up. An oil phase is prepared by mixing a paraffin solvent (299 g) and amphipathic polymeric stabilizer (1 g). This is charged into the vessel. An aqueous phase is prepared by mixing in a beaker, polyvinyl pyrrolidone K90 (12 g à 100%) and water (63 g). The compound (1a) (3 g à 20%) is dissolved/dispersed into this phase.

The aqueous phase is charged into the reaction vessel and the mixture stirred for five minutes.

Azeotropic removal of the water, under vacuum and at temperatures up to 90° C., by distillation is commenced and conducted until no further water can be recovered. After entrapment, the product is separated from the solvent by filtration and dried at room temperature.

The resultant particles A are non-dusting and so can be handeled with safety. They have excellent catalytic activity. They have a bulk density of 800 kg/m$^3$ which is at least two times higher than particles of the same compositions, but produced by spray-drying.

EXAMPLES 2–13

Preparation of Particles B–M

Particles B–M were prepared in a similar way as in Example 1. However, the polymers used and the ratios catalyst/polymer in the aqueous phase were different as described in the table below. In the particles J, K and L the polymer matrix was formed out of a blend of two different polymers.

| Particles | Polymer 1 | Polymer 2 | ratio Polymer 1: Polymer 2:catalyst |
|---|---|---|---|
| B | Polyvinyl pyrrolidone (PVP) K60 | — | 85:0:20 |
| C | PVP K90 | — | 80:0:15 |
| D | PVP K60 | — | 80:0:15 |
| E | PVP K90 | — | 100:0:0 |
| F | PVP K60 | — | 100:0:0 |
| G | Polyvinyl alcohol, 88–100% hydrolysis level (PVA) | — | 100:0:0 |
| H | PVA | — | 80:0:20 |
| I | PVA | — | 85:0:15 |
| J | PVA | PVP K90 | 20:60:20 |
| K | PVA | PVP K90 | 40:40:20 |
| L | PVA | PVP K90 | 60:20:20 |
| M | Poly methacrylic acid, Glascol KA 12 | — | 80:0:20 |

EXAMPLE 14

Release of the Manganese Complex into Solution

The goal is that the particles just release 100% of the catalyst content into a wash-liquor within the timeframe of a wash of about 30 min. The rate by which the manganese complex is released by the particles into an alkaline solution is determined as follows: 8 mg of the particles are added to 80 ml of borax buffer solution (T=40° C., pH=10) under magnetic stirring. After various times the solution is sampled and and a UV/Vis spectrum measured. The manganese complex has an absorption band at 485 nm. The optical density of a 20 ppm solution of (1a) at 385 nm is 1.13. The table shows the release profile of some particles prepared according to the invention.

| Particles | % catalyst (1a) released | | | | | | | |
|---|---|---|---|---|---|---|---|---|
| of example | 1 Min | 2 Min | 3 Min | 5 Min | 10 Min | 20 Min | 30 Min | 45 Min |
| B | 56 | 87 | 94 | 99 | 99 | 100 | 100 | 100 |
| C | 77 | 93 | 98 | 99 | 100 | 100 | 100 | 100 |
| I | 3 | 4 | 5 | 6 | 10 | 15 | 19 | 28 |
| J | 19 | 32 | 46 | 63 | 77 | 87 | 95 | 100 |

EXAMPLE 15

Compound (3a) is thermally unstable and starts to decompose at 80° C. whereby it looses its catalytic activity. If granules with this catalyst are produced by spray-drying or starting from a melt, temperatures of 80° C. and above are generally reached and these methods cannot be applied.

Particles are produced by the same method as described in Example 1, however instead of compound (1a) compound (3a) is used and during azeotroping pressure is reduced to such an extent that the temperature does not exceed about 50° C. The catalytic activity of the resulting particles is excellent.

What is claimed is:

1. Process for the preparation of water-soluble granules or particles of saldimine-manganese complexes and a polymeric dissolution restrainer, comprising a) mixing the polymeric material with water and subsequently dissolving/suspending the saldimine-type manganese complex in it to form an aqueous polymer phase containing the saldimine-manganese complex substantially uniformly distributed throughout the phase, b) simultaneously or subsequently dispersing the aqueous phase in a water immiscible liquid in the presence of a dispersion stabiliser to form a substantially stable dispersion, and c) azeotroping the dispersion to form substantially dry particles each comprising a matrix of the polymeric material with the saldimine-manganese complex dispersed substantially uniformly throughout the matrix.

2. A process according to claim 1, wherein as manganese complex a compound is used, that contains, complexed with manganese, from 1 to 3 saldimine groups, which are, groups obtainable by condensing unsubstituted or substituted salicylaldehydes with amines.

3. A process according to claim 2, wherein a compound of formula (1)

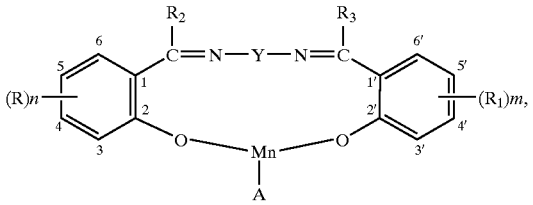

(2)

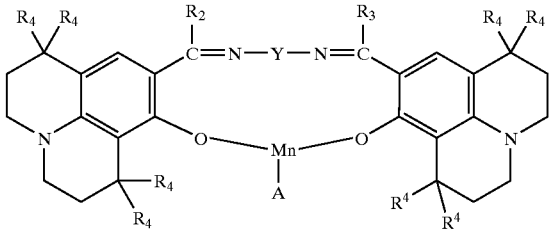

-continued (3)

or

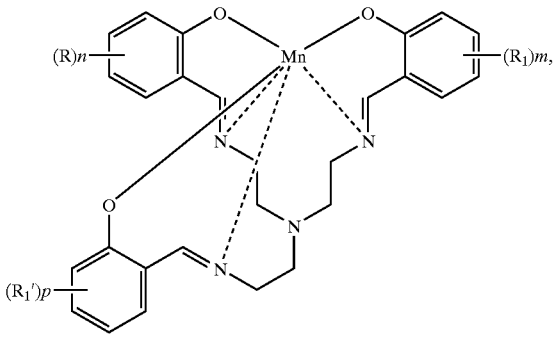

is used, wherein

A is an anion;

m, n and p are each independently of the others 0, 1, 2 or 3, $R_4$ is hydrogen or linear or branched $C_1$–$C_4$alkyl, Y is a linear or branched alkylene radical of formula —$[C(R_4)_2]_r$—, wherein r is an integer from 1 to 8 and the $R_4$ radicals are each independently of the others as defined above;

—CX=CX—, wherein X is cyano, linear or branched $C_1$–$C_8$alkyl or di(linear or branched $C_1$–$C_8$alkyl) amino;

—$(CH_2)_q$—$NR_4$—$(CH_2)_q$—, wherein $R_4$ is as defined above and q is 1, 2, 3 or 4; or a 1,2-cyclohexylene radical of formula:

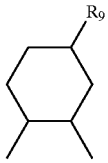

or a 1,2-aryl radical of formula

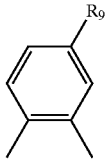

wherein $R_9$ is hydrogen, $SO_3H$, $CH_2OH$ or $CH_2NH_2$,

R, $R_1$ and $R_1$' are each independently of the others cyano; halogen; $OR_4$ or $COOR_4$ wherein $R_4$ is as defined above; nitro; linear or branched $C_1$–$C_8$alkyl; linear or branched partially fluorinated or perfluorinated $C_1$–$C_8$alkyl; or $NHR_6$, $NR_5R_6$ or $N\oplus R_5R_6R_7$ wherein $R_5$, $R_6$ and $R_7$ are the same or different and are each hydrogen or linear or branched $C_1$–$C_{12}$alkyl or wherein $R_5$ and $R_6$ together with the nitrogen atom to which they are bonded form a 5-, 6- or 7-membered ring, which may contain further hetero atoms, or are linear or branched $C_1$–$C_8$alkyl-$R_8$ wherein $R_8$ is a radical $OR_4$, $COOR_4$ or $NR_5R_6$ as defined above or is $NH_2$ or $N\oplus R_5R_6R_7$ wherein $R_5$, $R_6$ and $R_7$ are as defined above, $R_2$ and $R_3$ are each independently of the other hydrogen, linear or branched $C_1$–$C_4$alkyl, unsubstituted aryl or aryl that is substituted by cyano, by halogen, by $OR_4$ or $COOR_4$ wherein $R_4$ is hydrogen or linear or branched $C_1$–$C_4$alkyl, by nitro, by linear or branched $C_1$–$C_8$alkyl, by $NHR_5$ or $NR_5R_6$, wherein $R_5$ and $R_6$ are the same or different and are each linear or branched $C_1$–C12alkyl or wherein $R_5$ and $R_6$ together with the nitrogen atom to which they are bonded form a 5-, 6- or 7-membered ring, which may contain further hetero atoms, by linear or branched $C_1$–$C_8$alkyl-$R_7$ wherein $R_7$ is an $OR_4$, $COOR_4$ or $NR_5R_6$ radical as defined above or is $NH_2$, or by $N\oplus R_5R_6R_7$ wherein $R_5$, $R_6$ and $R_7$ are as defined above.

4. A process according to claim 1, wherein the granules or particles comprise from 1 to 90 % by weight of saldimine-manganese complex of formula (1), (2) or (3), based on the total weight of the granules or particles.

5. A process according to claim 1, wherein the polymeric dissolution restrainer is a compound that causes the manganese complex to dissolve in water more slowly than it would without the dissolution restrainer.

6. A process according to claim 1, wherein the polymeric dissolution restrainer is a compound selected from the group consisting of polyethylene glycols, copolymers of ethylene oxide with propylene oxide, gelatin, polyacrylates, polymethacrylates, polyvinylpyrrolidones, vinylpyrrolidones, vinyl acetates, polyvinylimidazoles, polyvinylpyridine N-oxides, copolymers of vinylpyrrolidone with long-chained α-olefins, copolymers of vinylpyrrolidone with vinylimidazole, poly(vinylpyrrolidone/dimethylaminoethyl methacrylates), copolymers of vinylpyrrolidone/dimethylaminopropyl methacrylamides, copolymers of vinylpyrrolidone/dimethylaminopropyl acrylamides, quaternised copolymers of vinylpyrrolidones and dimethylaminoethyl methacrylates, terpolymers of vinylcaprolactam/vinylpyrrolidone/dimethylaminoethyl methacrylates, copolymers of vinylpyrrolidone and methacrylamidopropyl-trimethylammonium chloride, terpolymers of caprolactam/vinyl-pyrrolidone/dimethylaminoethyl methacrylates, copolymers of styrene and acrylic acid, polycarboxylic acids, polyacrylamides, carboxymethylcellulose, hydroxymethylcellulose, polyvinyl alcohols, optionally hydrolysed polyvinyl acetate, copolymers of ethyl acrylate with methacrylate and methacrylic acid, copolymers of maleic acid with unsaturated hydrocarbons and mixed polymerisation products of the said polymers and synthetic polymers formed from an ethylenically unsaturated water soluble cationic monomer or monomer blend.

7. A process according to claim 6, wherein the polymeric dissolution restrainer is a compound selected from the group consisting of carboxymethylcellulose, polyethylene glycols, polyacrylamides, polyvinyl alcohols, polyvinylpyrrolidones, gelatin, hydrolysed polyvinyl acetate, copolymers of vinylpyrrolidone and vinyl acetate, polyacrylates, copolymers of ethyl acrylate with methacrylate and methacrylic acid, and polymethacrylates.

8. A process according to claim 1, wherein the polymeric dissolution restrainer is used in an amount of from 10 to 95 % by weight based on the total weight of the granules or particles.

* * * * *